United States Patent [19]

Lejosne

[11] Patent Number: 4,776,403

[45] Date of Patent: Oct. 11, 1988

[54] DEVICE FOR FIGHTING FOREST FIRES

[76] Inventor: Alain Lejosne, La Vieille Forge - 83470, Seillons-Source-D'Argent, France

[21] Appl. No.: 899,388

[22] PCT Filed: Dec. 5, 1985

[86] PCT No.: PCT/FR85/00350

§ 371 Date: Jul. 24, 1986

§ 102(e) Date: Jul. 24, 1986

[87] PCT Pub. No.: WO86/07272

PCT Pub. Date: Dec. 18, 1986

[30] Foreign Application Priority Data

Jun. 14, 1985 [FR] France ..... 85/09193

[51] Int. Cl.[4] ..... A62C 37/18

[52] U.S. Cl. ..... 169/61; 169/60; 169/57; 169/26; 169/51

[58] Field of Search ..... 169/61, 60, 51, 67, 169/70, 9, 13, 26, 91, 52, 54, 56, 57, 125; 239/203, 204; 340/602, 589

[56] References Cited

U.S. PATENT DOCUMENTS

| | | | |
|---|---|---|---|
| 1,501,956 | 7/1924 | Loepsinger | 169/9 |
| 2,287,873 | 6/1942 | Geertz et al. | 169/56 X |
| 3,567,125 | 3/1971 | Houghton | 239/204 |
| 3,709,435 | 1/1973 | Sheets | 239/204 X |
| 3,713,491 | 1/1973 | Grabowski et al. | 169/61 |
| 4,330,040 | 5/1982 | Ence et al. | 169/13 |
| 4,466,489 | 8/1984 | Lee | 169/57 X |
| 4,520,871 | 6/1985 | Miller et al. | 169/9 X |

FOREIGN PATENT DOCUMENTS

| | | | |
|---|---|---|---|
| 2565497 | 12/1985 | France | 169/54 |

*Primary Examiner*—Galen Barefoot
*Assistant Examiner*—James M. Kannofsky
*Attorney, Agent, or Firm*—Balogh, Osann, Kramer, Devorak, Genova & Traub

[57] ABSTRACT

A device having a first tank which is equipped with a telescopic vertical column which is contained in the folded state in the tank which contains a liquid and which bears a diffuser. The device includes a second reserve tank and further includes flame detectors distributed on the periphery of the tanks. When a flame is detected, an electronic central unit automatically controls pyrotechnical obturators which place bottles of compressed gas in communication with the first tank.

18 Claims, 6 Drawing Sheets

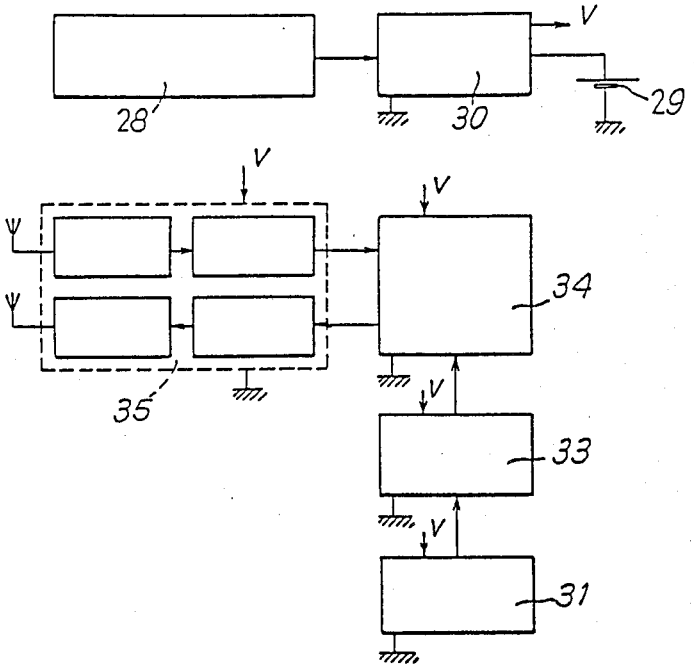
Fig. 7
Fig. 8
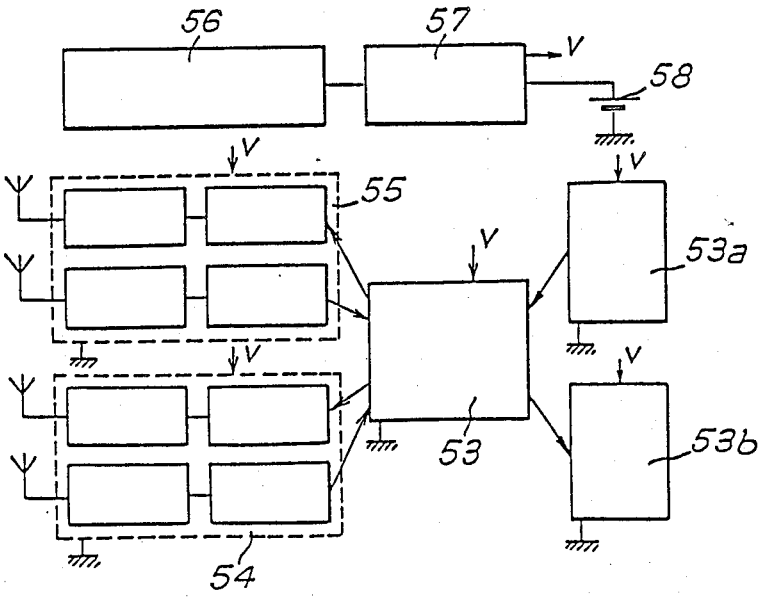

DEVICE FOR FIGHTING FOREST FIRES

The present invention has for its object devices for fighting forest fires. One objective of the present invention is to provide devices which are installed in the forests and which make it possible to fight efficiently against the fires by projecting, in a far-reaching perimeter surrounding each device, an extinguishing liquid propelled by a compressed gas.

One of the problems to be solved for a device installed at ground level is that the projecting the extinguishing liquid whilst avoiding the trees which surround the liquid diffuser.

Another problem is to trigger off spraying automatically whilst avoiding false alarms.

Pat. No. FR-A-2 344 302 (G. FABRE) describes a device for fighting against forest fires which comprises water cannons mounted to rotate at the top of a pylon anchored in the ground whose height is higher than that of the trees. This solution necessitates the construction of a high pylon which must be anchored in the ground and which must withstand the force of the wind, hence high installation costs.

This prior Patent describes an installation which comprises a plurality of detectors which measure climatic parameters such as temperature, hydrometric degree and wind velocity and which automatically trigger off a preventive spraying when certain climatic conditions are combined.

One objective of the invention is to provide devices which project an extinguishing liquid, particularly water, above the trees without necessitating the permanent presence of a pylon or any other similar high structure anchored in the ground.

Another objective of the invention is to provide means for automatically detecting a fire which are reliable and well adapted to the detection in a natural medium such as a forest which make it possible to trigger off spraying, whilst avoiding any untimely triggering due to causes other than the beginning of a fire.

The objectives of the invention are attained by means of a device which comprises:

a first tank containing an extinguishing liquid which is equipped with a telescopic vertical column which bears at its top a rotary diffuser and which is contained inside said reservoir in the folded state;

a source of compressed gas which is connected to said first tank through obturation means;

and means for controlling the opening of said obturation means in the event of a fire, with the result that said compressed gas places said extinguishing liquid under pressure and the latter rises in said column whilst unfolding it, with the result that said diffuser is located above the trees.

A device according to the invention is preferably an automatic device which comprises a plurality of flame detectors which are distributed about said first tank and at a distance therefrom and a central unit which comprises a radio station which communicates with said flame detectors and means for automatically controlling the opening of said obturation means when one of the detectors transmits to said radio station a flame detection signal.

The flame detectors are advantageously constituted by ambient temperature sensors associated with electronic circuits which calculate the speed of variation of the temperature and which compare this speed with a determined threshold.

A device according to the invention preferably comprises a second tank which is equipped with a pump for transferring the liquid that it contains into the first tank.

A device according to the invention advantageously comprises articulated flaps which are normally folded down above said tanks and which are automatically opened in the event of rain in order to collect the rainwater and to send it into said second tank.

The invention has for result devices which may be installed in a forest and which make it possible to fight a fire, automatically or not.

The automatic devices according to the invention make it possible to fight without delay, therefore very efficiently, against a fire as soon as the latter is detected.

The devices according to the invention are particularly well adapted to protect certain sites exposed to forest fires, for example to protect a house which is surrounded by forests.

An alignment of devices according to the invention may be used for constituting a fire-break curtain intended to stop the propagation of a fire along a determined line in a forest.

Thanks to the telescopic columns which fold inside the water tank and to the flaps which cover them, the devices according to the invention are well protected from bad weather, risks of damage due to possible falls of trees and from acts of vandalism. The telescopic columns moved by the thrust due to the pressure of the compressed gas make it possible to place the water diffuser above the trees at the instant when the fire is detected and to project water within a far-reaching circular perimeter without the water being stopped by the trees.

The detectors according to the invention which are supplied by photo-voltaic cells and which communicate with the central unit by radio are entirely independent. They do not require the placing of any electrical line which would risk being deteriorated by the fire. In the event of their being equipped with flaps collecting rainwater, they may also be independent of any source of water supply.

The fire detectors constituted by temperature sensors which are associated with electronic circuits which calculate the speed of variation of temperature make it possible to detect the approach of the flames in very reliable manner independently of the slow variations in temperature due to the climatic conditions.

The devices according to the invention equipped with a telescopic column whose base is located inside a tank present the advantage that this tank serves to support the foot of the column and to give it a good stability against tipping over. Consequently, the column does not need to be anchored in the ground and a device according to the invention may be easily displaced.

The following description refers to the accompanying drawings which represent, without any limiting character, an embodiment of a device according to the invention.

FIGS. 7 and 8 are block diagrams showing the essential electronic components of a flame detector and of the central unit.

FIG. 1 shows a schematic view of a device according to the invention implanted in the ground in a forest in order to protect part of it from fire. Several identical devices may of course be distributed in the forest.

Figure 2:
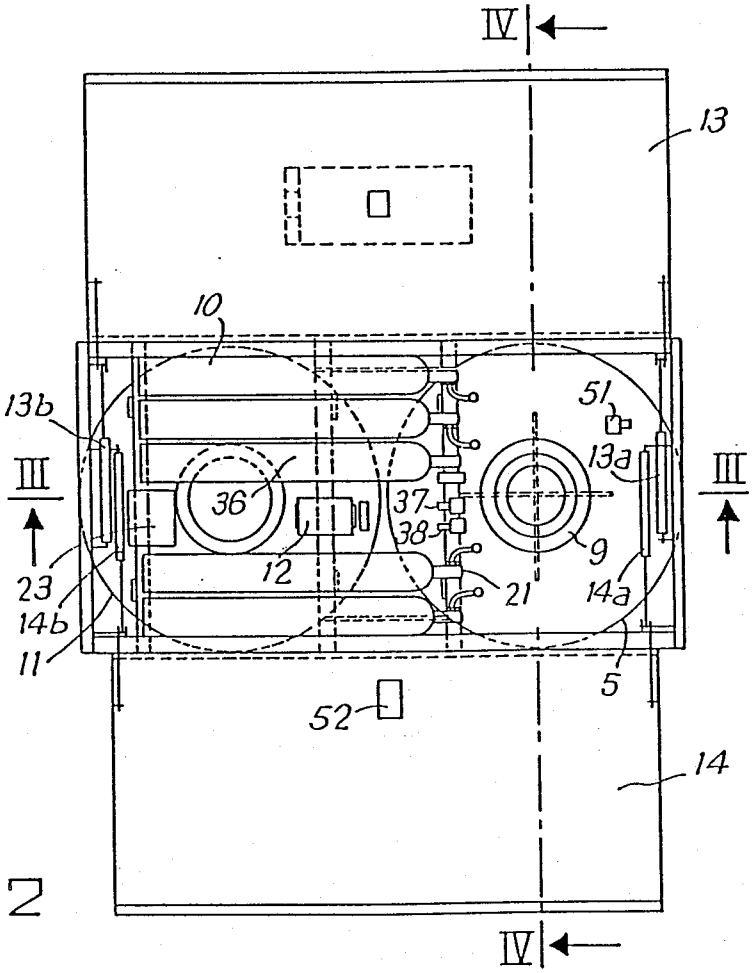
FIG. 2 is a plan view of the central unit of a device according to the invention.
Figure 1:
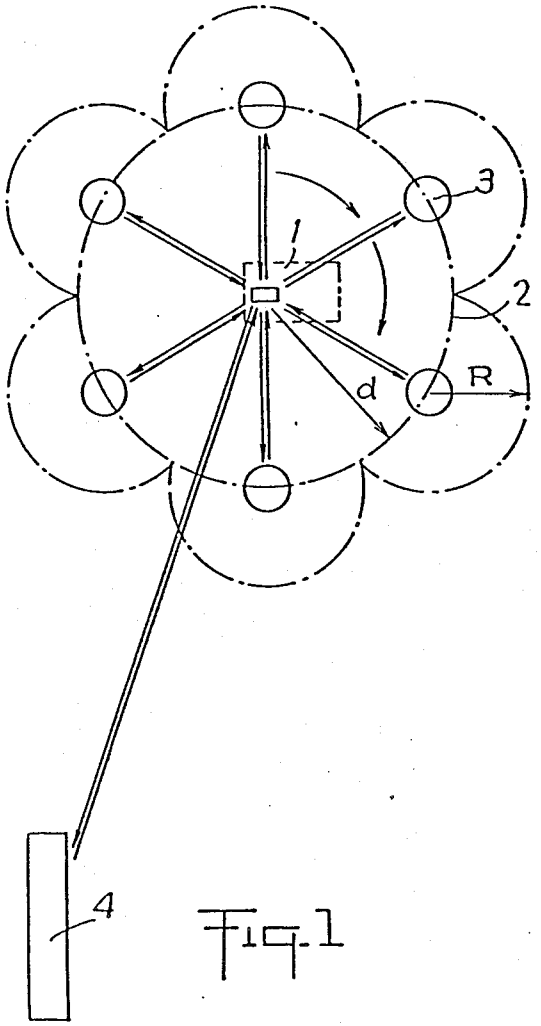
FIG. 1 is a plan view showing the implantation on the terrain of a device according to the invention.

Each device comprises a central unit 1 which will be described hereinbelow and which comprises a rotary diffuser which projects an extinguishing liquid, for example water, propelled by a compressed gas within a circular perimeter 2, of which the radius is equal to the range of the diffuser which is for example of the order of 50 meters. Several fire detectors 3, for example six in the example shown, are disposed around the diffuser 1, for example in the vicinity of perimeter 2.

Each detector 3 has a radius of action R, of the order of 25 m over the whole of its periphery, i.e. it reacts when flames appear in a perimeter of 25 m of radius surrounding the sensor.

The central unit 1 comprises a radio emitter-receiver station which cyclically interrogates the various detectors. Each detector 3 comprises a radio emitter-receiver station which sends a signal to the radio station of the central unit when it is interrogated.

The central unit 1 comprises a radio link with a remote control station 4 to which several central units 1 may be connected.

Figure 3:
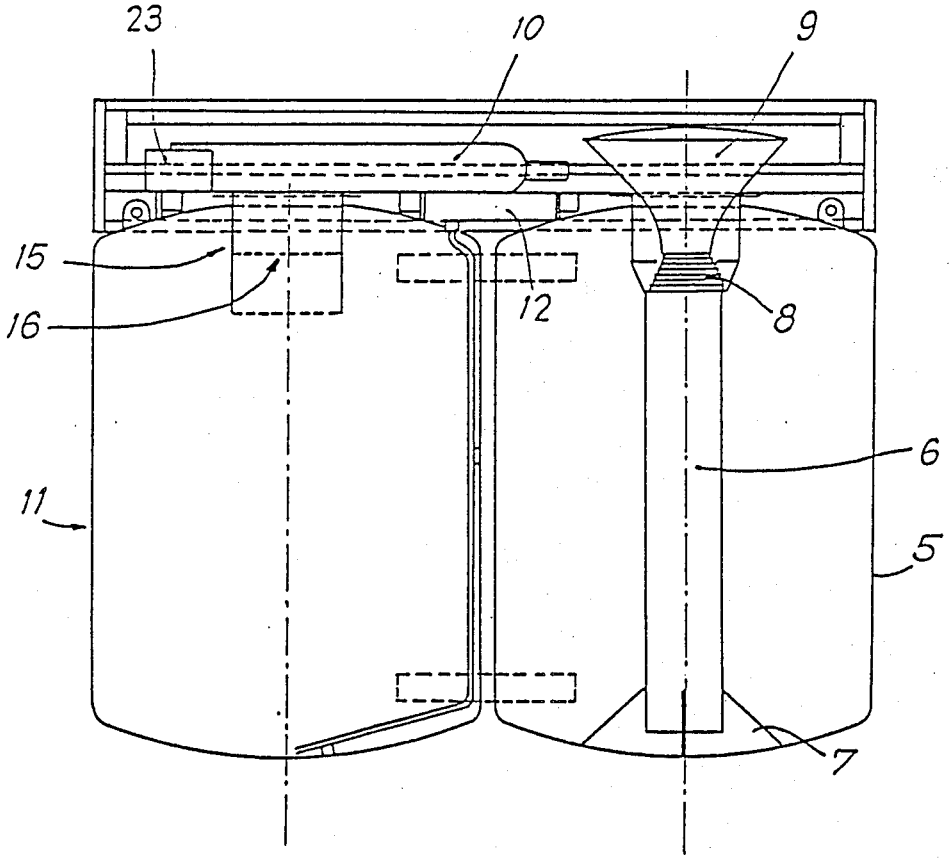
FIGS. 3 and 4 are sections along III—III and IV—IV of FIG. 2.
Figure 4:
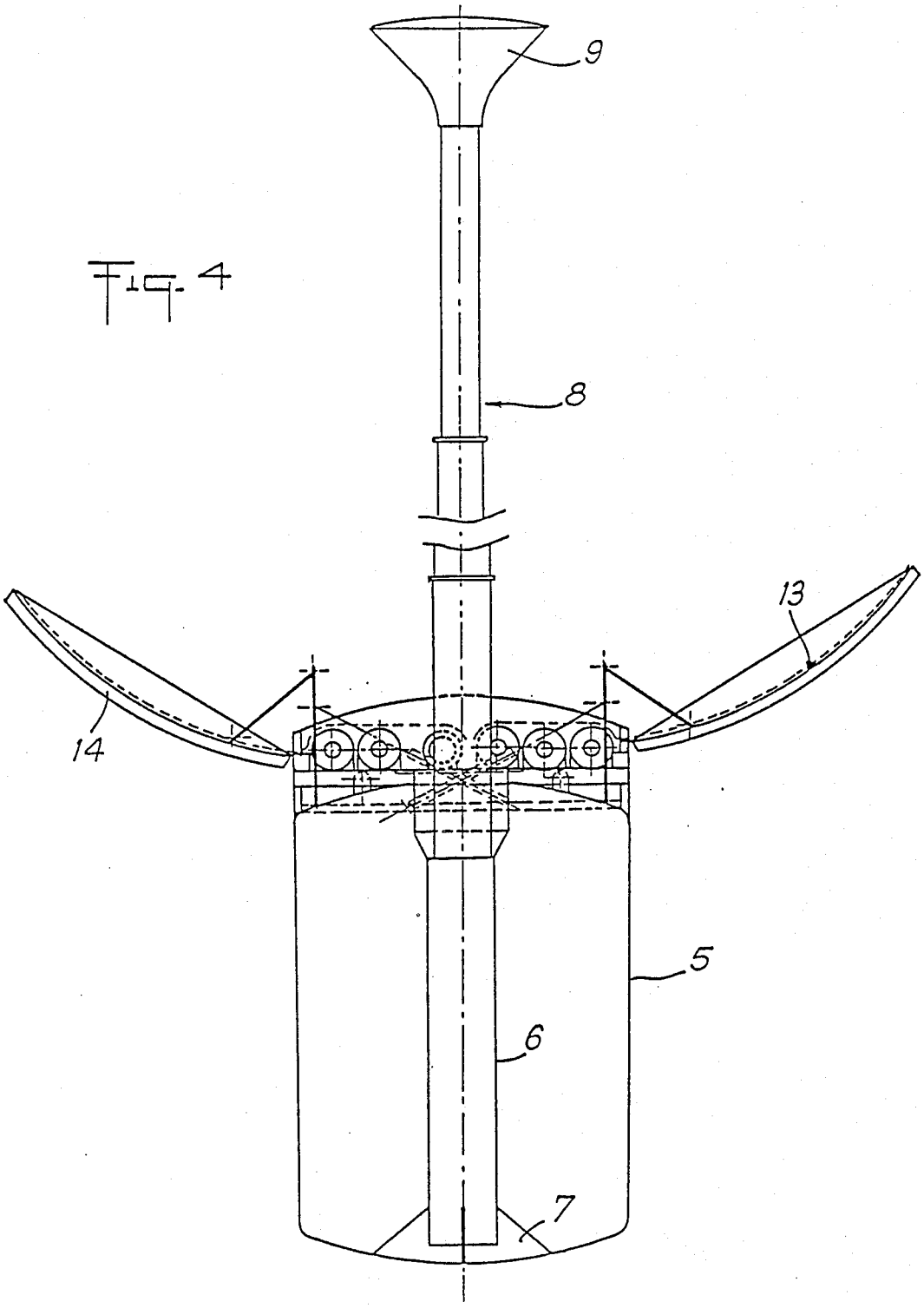

FIGS. 2 to 4 represent a plan view and two vertical sections along III—III and along IV—IV of an embodiment of a central unit 1. In this example, the central unit comprises a first tank 5 which is advantagoeusly a vertical cylindrical tank. This tank comprises a vertical axial well 6 which is suspended from the upper bottom of the tank and of which the lower end is located slightly above the lower bottom of the tank and is supported by feet or gussets 7.

The axial well 6 constitutes the lower element of a hollow telescopic column 8 of which all the elements have a length less than the height of the tank 6, with the result that, in the folded state, the telescopic column 8 is contained inside the well 6 and the tank 5 as shown in FIG. 3. The upper element of column 8 bears a rotary diffuser 9 at its upper end.

The tank 5, which has a capacity of several cubic meters, contains an extinguishing liquid capable of extinguishing the fire, for example water or a mixture of water and a product having extinguishing properties.

Tank 5 is connected to a source of compressed gas, for example bottles of compressed gas 10 which are connected to tank 5 via a pyrotechnical obturator whose firings are controlled either manually or automatically in the event of the central unit receiving from one of the detectors 3 a signal indicating that the speed of variation of the temperature has exceeded a threshold.

In that case, the compressed gas which is admitted into tank 5 places the liquid under pressure, this having for its effect to eject the telescopic column 8 out of the tank then to spray the zone included within the perimeter 2.

FIGS. 2 to 4 represent a device according to the invention which comprises a second tank 11 which serves as reserve of liquid for tank 5.

Tank 11 is equipped with a pump 12 which makes it possible to transfer the liquid that it contains into tank 5 to refill the latter in order to ensure fresh sprayings. The capacity of tank 11 is preferably greater than that of tank 5.

The liquid used is generally water and, in that case, the pump 12 may also serve to send the water into a spraying network.

In the embodiment shown in FIGS. 2 to 4 by way of example, the installation comprises two flaps 13 and 14 which are located on either side of the two tanks to collect the rainwater and to send it into tank 11.

Flaps 13 and 14 are advantageously articulated about a pivot pin and each flap is actuated by two pneumatic jacks 13*a*, 13*b* and 14*a*, 14*b*, which are supplied with compressed air for example through electrovalves 37, 38 from an annexed bottle of compressed air 36.

Outside the rain periods, flaps 13 and 14 are folded down above the central unit and they protect it from bad weather, possible falls of trees and acts of vandalism.

Tank 11 is equipped with an inspection port 15 through which the water collected by flaps 13 and 14 flows into the tank. This inspection port is equipped with a sieve 16 which stops the vegetable waste taken along by the rainwater.

Figure 6:
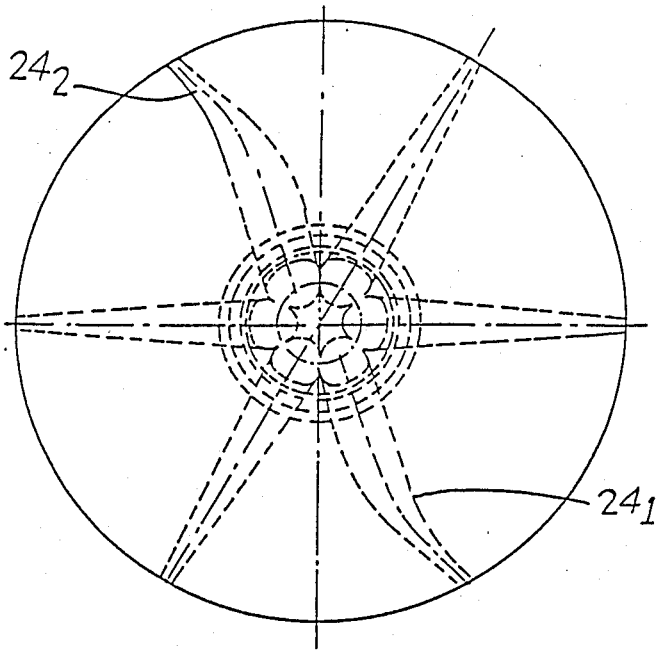
FIGS. 5 and 6 are views in axial section and from above of the telescopic column.
Figure 5:
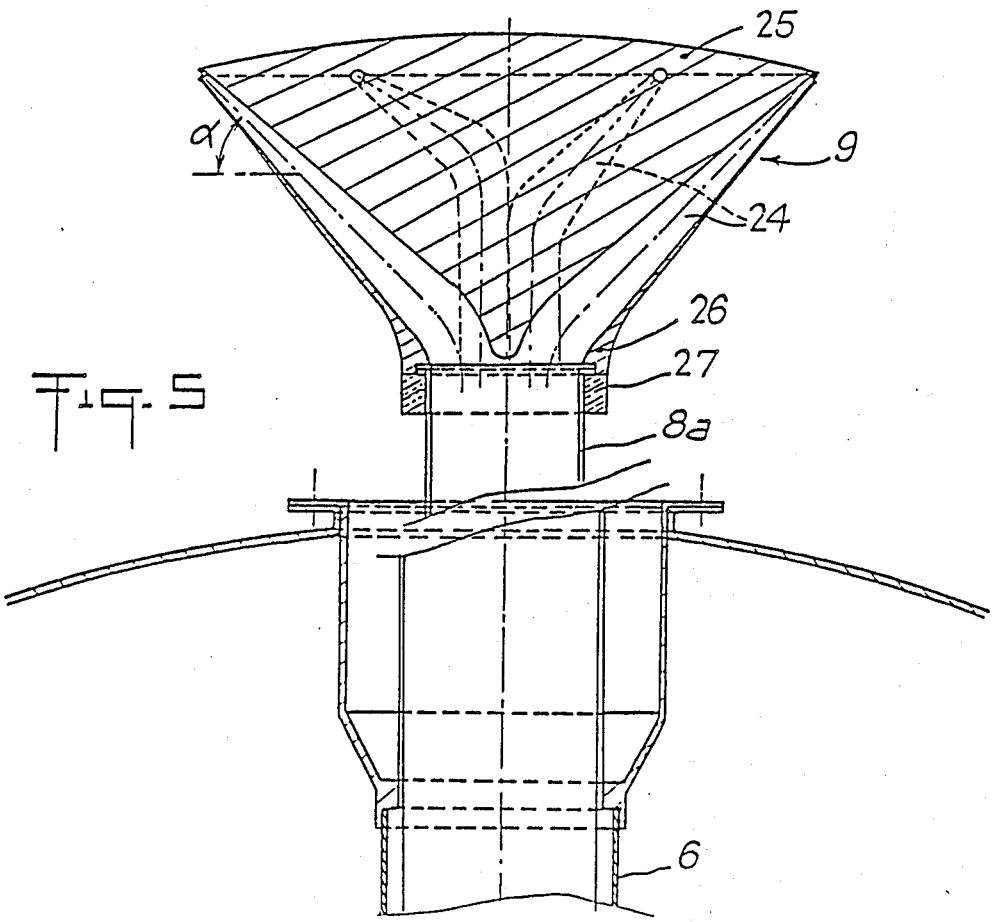

FIGS. 5 and 6 respectively show a view in axial section and a plan view of a preferred embodiment of the diffuser 9, placed at the top of the telescopic column 8, of which only the upper element 8*a* and the lower element 6 have been shown in FIG. 6.

The diffuser 9 comprises a body which is tranversed by channels or nozzles 24 which open out on the periphery and which communicate with the top of the last element 8*a* of the telescopic column. The channels 24 are diametrically opposite in two's.

The axes of the outlet sections of the nozzles form, with the horizontal, angles $\alpha$ variable from one couple of nozzles to the other, with the result that the ranges of the different nozzles are different and the liquid is distributed with perimeter 2. Two diametrically opposite nozzles, for example nozzles $24_1$ and $24_2$, shown in FIG. 6, are slightly bent in the horizontal plane.

The head of the diffuser is mounted on the top of the element 8*a* via a runway, for example a ball race 27 and it is driven in rotation by the torque exerted by the tangential thrusts of the jets of water emerging from bent nozzles $24_1$ and $24_2$.

FIG. 7 is a block diagram of the electronic circuits of a preferred embodiment of a detector 3. Each detector comprises a panel of photovoltaic cells 28 which charge a battery 29 via control circuits 30 which monitor the charge of the battery and which deliver a regulated voltage to the electronic components.

Each detector comprises a temperature sensor 31, of any known type, which delivers an electric signal approximately proportional to the ambient temperature. This signal, converted into digital values by an analog-to-digital converter 33, is sent into the memory of a microprocessor 34. This microprocessor is programmed to correct the values of the signal in order to render them strictly proportional to the temperature. In fact, according to one feature of the present invention, in order to avoid false alarms to a maximum, the speed of variation of the ambient temperature, i.e. the derivative with respect to time of the temperature, is used as parameter indicating the approach of a fire, with the result that detection is independent of the temperature level which depends on the climatic conditions and the hour of the day or night.

Now, the temperature sensors sold on the market deliver a signal which does not follow the temperature in strictly proportional manner.

Although this lack of precision in the coefficient of proportionality of the sensor brings about only small errors on the temperature indicated by the sensor, it may cause much greater errors on the derivative of the temperature which would risk leading to false alarms.

Each temperature sensor must therefore be previously calibrated in order to render it linear. In the course of this prior calibration, the sensor is placed in an enclosure of which the temperature is varied linearly.

The temperature is periodically measured with a precision thermometer and each time, the values of the signal delivered by the sensor are noted, the variation curve of the signal delivered by the sensor is established and, by comparing it with the straight line of variation of the temperature, there is noted for each value of the temperature the algebraic variation between the real value of the signal and the theoretical value which should be that of the signal if it varied linearly.

The digital value of this variation is recorded in the memory of the microprocessor for each temperature range, and the microprocessor 34 is programmed to subtract each time the value of this recorded variation from the digital value of the signal delivered by the converter 33 in order to obtain corrected digital values which vary strictly proportionally to the temperature.

The microprocessor is also programmed to calculate the derivative of the corrected signal, i.e. the speed of variation or the difference in temperature per unit of time.

The variation in temperature due to the climatic conditions is normally a very slow linear variation for example of the order of some degrees per hour and in that case, the derivative is therefore constant and virtually zero.

If a fire approaches a sensor, the temperature increases suddenly, for example by several tens of degrees per minute.

The microprocessor 34 periodically calculates the speed of variation of the temperature and compares it with a threshold clearly higher than the speed due to the climatic conditions. If this threshold is exceeded, the microprocessor memorizes a threshold-overshooting signal which reliably indicates the approach of a fire.

Each detector further comprises a radio emitter-receiver station 35 made in a hybrid assembly.

This radio station is interrogated periodically by the radio station which equips the central unit 1. The central unit cyclically interrogates the detectors one after the other. Each detector comprises a coded address recorded in its memory.

Each interrogation comprises an address which the detector compares with its own address. If the addresses are identical, it replies by emitting its address completed by coded information indicating the state of detection, i.e. indicating whether the speed of variation of the temperature recorded in the memory is greater or less than the triggering threshold.

FIG. 8 is a block diagram of the essential electronic components of the central unit 1. The latter comprises a microprocessor 53 which is equipped with a input interface unit 53*a* and an output interface unit 53*b*. In addition, it comprises a first radio emitter-receiver 54 of reduced range which communicates with the radio stations equipping each detector 3 and which transmits the information received therefrom to the microprocessor 53.

It comprises a second radio emitter-receiver station 55 of average range which communicates with a remote control station 4.

Reference 56 represents photo-voltaic cells which charge a battery of accumulators 58 through charge monitoring circuits 57. The battery 58 supplies the electronic circuits which compose the central unit 1.

The microprocessor 53 successively interrogates the various detectors 3, sending by radio in coded form the addresses of the different detectors. It analyzes each message received from a detector.

If the message received corresponds to a state of watch, the central unit questions the following detector. If the message delivered by a detector corresponds to a state of alert, i.e. to an overshooting of the threshold of speed of variation of temperature, the microprocessor interrogates a second time the same detector in order to obtain confirmation. If the state of alert is confirmed, the microprocessor automatically triggers off spraying.

In the event of the central unit comprising pivoting flaps 13 and 14, if the latter are closed, the microprocessor firstly controls the opening of the electro-valves 37, 38 supplying compressed air to jacks 13*a*, 13*b*, 14*a* and 14*b* which actuate the flaps to open them. When the flaps are open, end-of-stroke switches deliver a signal and when it has received the latter, the microprocessor controls firing of the pyrotechnical obturators 21 with which the bottles of compressed gas 10 are equipped. The compressed gas arrives in tank 5 and drives the water into the telescopic column 8 which unfolds out of the tank. The water is projected by the rotary diffuser.

Tank 5 is equipped with a low level sensor which transmits a signal to the microprocessor of the central unit when this low level is attained. The microprocessor then controls the opening of a purge valve 51 with which tank 5 is equipped. The gas remaining in the tank escapes and the telescopic column redescends by gravity as the pressure decreases. When the column is completely folded, an end-of-stroke switch is actuated and it transmits a signal to the microprocessor which controls closure of the flaps 13 and 14, with the result that the central unit is protected.

When the central unit 1 receives a signal of detection of a fire, it transmits by radio a signal to the control station 4, indicating the address of the detector which has triggered off the alert.

Figure 9:
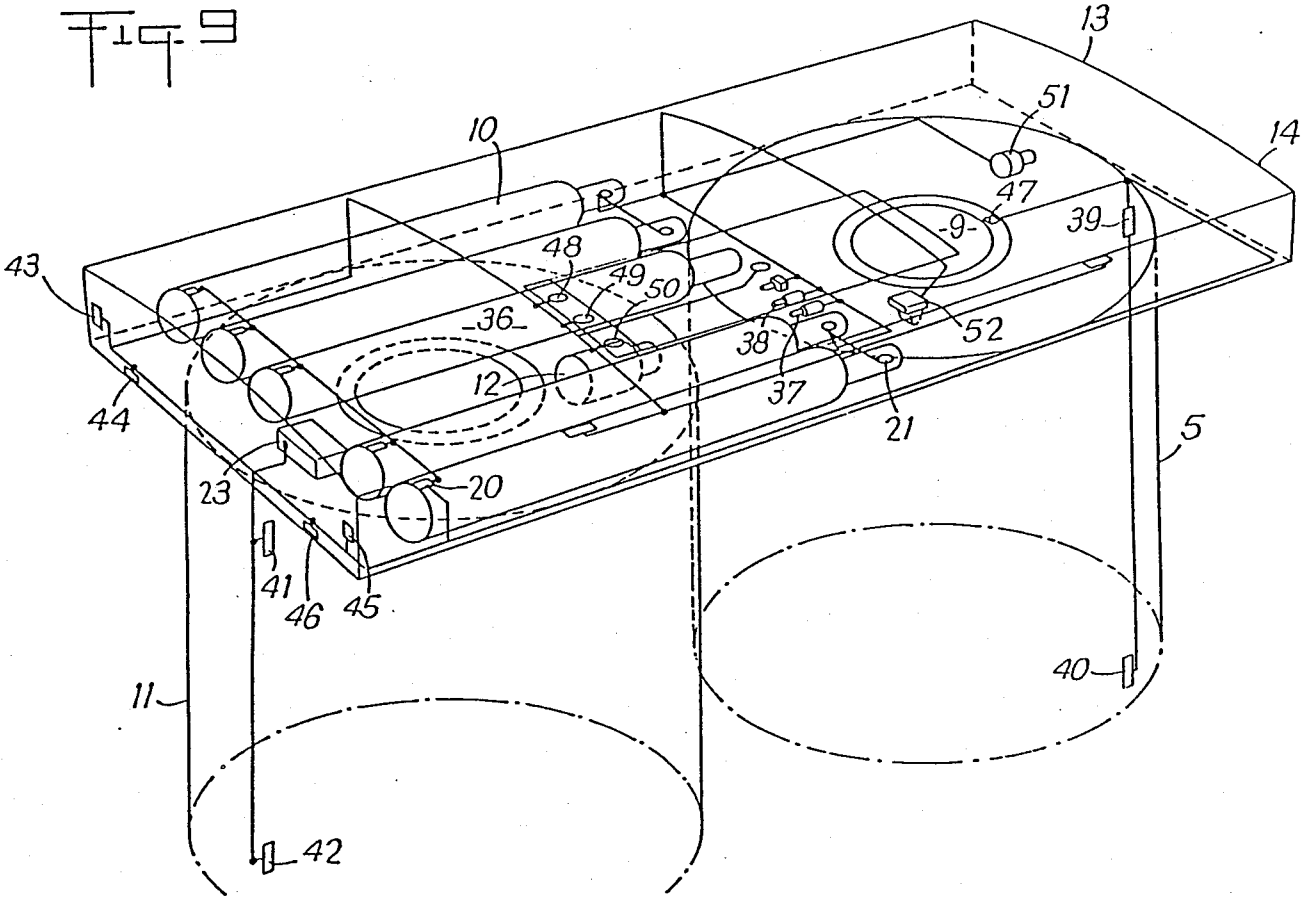
FIG. 9 is a view in perspective of the central unit.

FIG. 9 is an overall view in perspective of a central unit 1 comprising a first tank 5 equipped with a telescopic column bearing a diffuser 9 and a second tank 11. This Figure shows the bottles of compressed gas 10 which are connected via pyrotechnical obturators 21 to tank 5. Also shown is an auxiliary bottle of compressed air 36 which supplies, via electro-valves 37, 38, the jacks 13*a*, 13*b* and 14*a*, 14*b* which control the opening of flaps 13 and 14. Also shown in pump 12 and the cabinet 23 which contains the electronic circuits, particularly the microprocessor and the radio emitter-receiver stations which communicate with the fire detectors and with the control station 4.

Tank 5 is equipped with a high level detector 39 and a low level detector 40. Tank 11 is equipped with a high level detector 41 and with a low level detector 42.

The pivoting flap 13 is equipped with an end-of-stroke switch 43 indicating the open position and with an end-of-stroke switch 44 indicating the closed position. Similarly, flap 14 is equipped with two end-of-stroke switches indicating the open position (45) and closed position (46).

The telescopic column is equipped with an end-of-stroke switch 47 indicating that the column is folded. Each bottle 10 is equipped with a switch or a sensor 20 indicating that the bottle is empty.

Reference 48 represents a hygrometry sensor. Reference 49 represents a temperature sensor. Reference 50 represents a photo-electric cell indicating day and night. Reference 51 represents the purge electro-valve of the tank 5.

Reference 52 represents an electro-magnetic device for locking the flaps 13 and 14 in closed position.

The microprocessor 53 with which the central unit is equipped automatically controls the recovery of rainwater, the irrigation and extinguishing of a fire.

When the hygrometry sensor 48 detects rain, it transmits a signal to the microprocessor 53. The latter controls the locking device 52 to unlock the flaps 13 and 14. It then controls the opening of the electro-valves 37 and 38 which supply compressed air to the jacks. The latter control the opening of the flaps 13 and 14 which occupy the position shown in FIG. 2.

The rainwater collected by the flaps flows towards chutes which conduct it towards the sieve 16 with which tank 1 is equipped. As soon as the high level 48 is attained, or the hygrometric degree descends below a minimum threshold, the microprocessor 53 controls the reverse operations.

Irrigation is automatically controlled from the information delivered by the hygrometry sensor 48, the temperature sensor 49 and the photo-electric cell 50.

If the hygrometric degree remains less than a minimum threshold for three consecutive days, the microprocessor 53 controls operation of the pump 12 during the following night.

If the temperature during the day exceeds a determined maximum threshold and if at the same time the hygrometric degree is less than a minimum threshold, pump 12 is also controlled during the following night.

Irrigation may also be remotely controlled by radio from the control station 4.

The foregoing drawings and description concern an automatic device in which extinguishing of the fire is automatically controlled by a microprocessor associated with fire detectors. It is specified that a device according to the invention does not necessarily comprise automatisms and communication between the bottles of compressed gas and the first tank may be controlled either locally or remotely from the control station.

I claim:

1. Device for fighting forest fires, characterized in that it comprises:

a first tank (5) containing an extinguishing liquid which is equipped with a telescopic vertical column (8) which bears at its top a rotary diffuser (9) and which is contained inside said first tank in the folded state;

a source of compressed gas (10) which is connected to said first tank (5) through obturation means (21);

and means for controlling the opening of said obturation means in the event of a fire, with the result that said compressed gas places said extinguishing liquid under pressure and the latter rises in said column whilst unfolding it, with the result that said diffuser (9) is located above the trees.

2. Device according to claim 1, characterized in that said source of compressed gas is constituted by bottles of compressed gas (10) which are each equipped with a pyrotechnical obturator (21) whose firing establishes the communications between said bottles (10) and said first tank (5).

3. Device according to claim 1, characterized in that said first tank (5) is equipped with a purge valve (51), with a high level sensor (39) and a low level sensor (40) and said central unit comprises a microprocessor (53) which automatically controls the opening of said purge valve when it receives a signal from said low level sensor (40).

4. Device according to claim 1, characterized in that said central unit (1) comprises a hygrometry sensor (48) and a microprocessor (53) which automatically controls the opening of said flaps (13, 14) when it receives from said hygrometry sensor a signal indicating that the hygrometric degree has exceeded a determined threshold.

5. Device according to claim 4, characterized in that said central unit (1) comprises a temperature sensor (49), a photo-electric cell (50) and a spray pump (12) which pumps the water contained in said second tank and said microprocessor (53) automatically controls operation of said spray pump (12) during the night when certain combinations of hydrometric degree and of temperature are combined.

6. Device for fighting forest fires comprising:

a first tank containing an extinguishing liquid which is equipped with a telescopic vertical column which bears at its top a rotary diffuser, which column is contained inside said tank in the folded state;

a source of compressed gas which is connected to said first tank via obturation means;

a plurality of flame detectors which are distributed in the forest about said first tank and at a distance therefrom, said flame detectors being constituted by ambient temperature sensors associated with electronic circuits which calculate the rate of variation of the temperature and which compare this rate with a determined threshold; and a central unit which comprises a radio station which communicates with said flame detectors and which automatically opens said obturation means when one of the detectors transmits to said radio station a flame detection signal with the result that said compressed gas places said extinguishing liquid under pressure and said liquid rises in said column while unfolding it with the result that said rotary diffuser is located above the trees.

7. Device according to claim 6, characterized in that said source of compressed gas is constituted by bottles of compressed gas which are each equipped with a pyrotechnical obturator whose firing establishes the communications between said bottles and said first tank.

8. Device according to claim 6, wherein each flame detector comprises:

a temperature sensor, which delivers an electric signal proportional to the ambient temperature;

an analog to digital converter which samples said signal and which has a digital output which delivers digital values of each sample;

a microprocessor having an input connected to the digital output of said converter and which is programmed to calculate the rate of variation of the signal, to compare this rate with a threshold and to emit a signal when said threshold is reached; and a radio emitter-receiver which is connected to said microprocessor and which emits a signal when it receives said signal emitted by said microprocessor and photo-voltaic cells coupled with a battery of accumulators which supplies said sensor, said microprocessor and said radio emitter-receiver.

9. Device according to claim 8, characterized in that said source of compressed gas is constituted by bottles of compressed gas which are each equipped with a pyrotechnical obturator whose firing establishes the communications between said bottles and said first tank.

10. Device according to claim 6, characterized in that said source of compressed gas is constituted by bottles of compressed gas which are each equipped with a phyrotechnical obturator whose firing establishes the communications between said bottles and said first tank.

11. Device for fighting forest fires comprising:

a first tank containing an extinguishing liquid which is equipped with a telescopic vertical column which bears a rotary diffuser at the top thereof, which column is contained in said tank in the folded state;

a source of compressed gas which is connected to said first tank through obturation means; and a plurality of flame detectors which are distributed in the forest about said tank and at a distance therefrom and which command the opening of said obturation means in the event of a fire, with the result that said compressed gas places said extinguishing liquid under pressure and that said liquid rises in said column while unfolding it so that said rotary diffuser is located above the top level of the trees;

wherein said tank comprises articulated flaps which are normally folded down above said tank and means for automatically unfolding said flaps in the event of rain in order to collect the rainwater into said tank.

12. Device according to claim 11, wherein each of said flame detectors comprises:

a temperature sensor which delivers an electric signal proportional to the ambient temperature;

an analog to digital converter which samples said signal and which has a digital output which delivers digital values of each sample;

a microprocessor having an input connected to the digital output of said converter and which is programmed to calculate the rate of variation of the signal, to compare this rate with a threshold and to emit a signal when said threshold is reached; and a radio emitter-receiver which is connected to said microprocessor and which emits a signal when it receives said signal emitted by said microprocessor and photovoltaic cells coupled with a battery of accumulators which supplies said sensor, said microprocessor and said radio emitter-receiver.

13. Device for fighting forest fires, characterized in that it comprises:

a first tank containing an extinguishing liquid which is equipped with a telescopic vertical column which bears at its top a rotary diffuser and which is contained inside said first tank in the folded state;

a source of compressed gas which is connected to said first tank through obturation means;

means for controlling the opening of said obturation means in the event of a fire, with the result that said compressed gas places said extinguishing liquid under pressure and the latter rises in said column while unfolding it, with the result that said diffuser is located above the trees;

a second tank which is equipped with a pump for transferring a liquid from the second tank into the first tank; and articulated flaps which are folded down above said tanks and which are automatically opened in the event of rain in order to collect the rainwater and to send it into said second tank.

14. Device according to claim 13, wherein said first tank is equipped with a purge valve, with a high level sensor and a low level sensor and said central unit comprises a microprocessor which automatically controls the opening of said purge valve when it receives a signal from said low level sensor.

15. Device according to claim 13, wherein said central unit comprises a hygrometry sensor and a microprocessor which automatically controls the opening of said flaps when it receives from said hygrometry sensor a signal indicating that the hygrometric degree has exceeded a determined threshold.

16. Device according to claim 15, wherein said central unit comprises a temperature sensor, a photo-electric cell and a spray pump which pumps the water contained in said second tank, and said microprocessor automatically controls operation of said spray pump during the night when certain combinations of hydrometric degree and of temperature are combined.

17. Device according to claim 13, wherein said source of compressed gas is constituted by bottles of compressed gas which are each equipped with a pyrotechnical obturator whose firing establishes the communications between said bottles and said first tank.

18. Device according to claim 13, wherein each flame detector comprises a temperature sensor, an analog-to-digital converter, a microprocessor, a radio emitter-receiver station, photovoltaic cells and a battery of accumulators which supplies the electronic circuits.

* * * * *